US005089369A

United States Patent [19]

Yu

[11] Patent Number: 5,089,369

[45] Date of Patent: * Feb. 18, 1992

[54] STRESS/STRAIN-FREE ELECTROPHOTOGRAPHIC DEVICE AND METHOD OF MAKING SAME

[75] Inventor: Robert C. U. Yu, Webster, N.Y.

[73] Assignee: Xerox Corporation, Stamford, Conn.

[ * ] Notice: The portion of the term of this patent subsequent to Jan. 8, 2008 has been disclaimed.

[21] Appl. No.: 545,817

[22] Filed: Jun. 29, 1990

[51] Int. Cl.[5] ..... G03G 5/047; G03G 5/10

[52] U.S. Cl. ..... 430/96; 430/58; 430/130

[58] Field of Search ..... 430/59, 56, 58, 69, 430/126, 930, 96, 130

[56] References Cited

U.S. PATENT DOCUMENTS

| | | | |
|---|---|---|---|
| 3,121,006 | 2/1964 | Middleton et al. | 430/69 |
| 3,357,989 | 12/1967 | Byrne et al. | 260/314.5 |
| 3,442,781 | 5/1969 | Weinberger | 204/181 |
| 4,265,990 | 5/1981 | Stolka et al. | 430/59 |
| 4,286,033 | 8/1981 | Neyhart et al. | 430/58 |
| 4,291,110 | 9/1981 | Lee | 430/59 |
| 4,338,387 | 7/1982 | Hewitt | 430/58 |
| 4,582,772 | 4/1986 | Teuscher et al. | 430/58 |
| 4,587,189 | 5/1986 | Hor et al. | 430/59 |
| 4,664,995 | 5/1987 | Horgan et al. | 430/59 |
| 4,702,980 | 10/1987 | Matsuura et al. | 430/63 |
| 4,747,992 | 5/1988 | Sypula et al. | 264/180 |
| 4,756,993 | 7/1988 | Kitatani et al. | 430/69 |
| 4,895,784 | 1/1990 | Shirai | 430/69 |
| 4,983,481 | 1/1991 | Yu | 430/56 |

*Primary Examiner*—John Goodrow
*Attorney, Agent, or Firm*—Oliff & Berridge

[57] ABSTRACT

In an electrophotographic imaging member having a supporting substrate and a charge generating layer, the supporting substrate is made of a material having a thermal contraction coefficient which is substantially the same as that of the charge generating layer. Substrate materials having a thermal contraction coefficient between about $5.0\times10^{-5}$/°C. and about $9.0\times10^{-5}$/°C. are preferred for use in combination with a benzimidazole perylene charge generating layer.

24 Claims, 1 Drawing Sheet

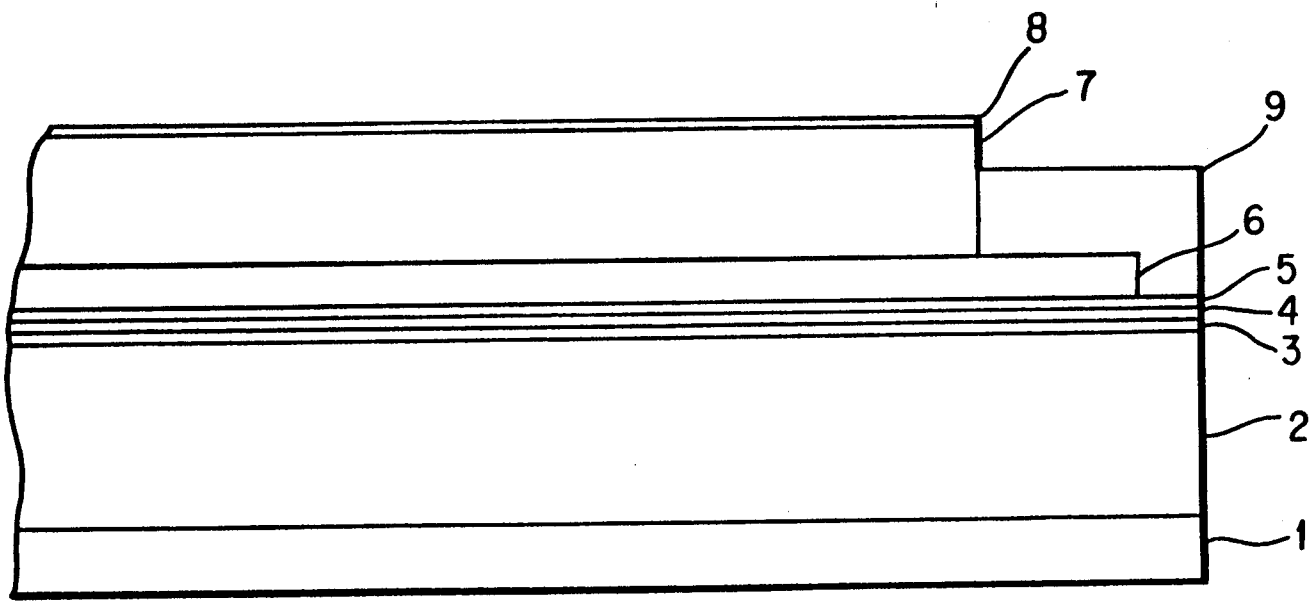
8
7
9
6
5
4
3
2
1

STRESS/STRAIN-FREE ELECTROPHOTOGRAPHIC DEVICE AND METHOD OF MAKING SAME

BACKGROUND OF THE INVENTION

This invention relates in general to electrophotography and, in particular, to electrophotoconductive imaging members having multiple layers.

In electrophotography, an electrophotographic plate containing a photoconductive insulating layer on a conductive layer is imaged by first uniformly electrostatically charging its surface. The plate is then exposed to a pattern of activating electromagnetic radiation such as light. The radiation selectively dissipates the charge in the illuminated areas of the photoconductive insulating layer while leaving behind an electrostatic latent image in the non-illuminated areas. This electrostatic latent image may then be developed to form a visible image by depositing finely divided electroscopic marking particles on the surface of the photoconductive insulating layer. The resulting visible image may then be transferred from the electrophotograhic plate to a support such as a paper. This imaging process may be repeated many times with reusable photoconductive insulating layers.

An electrophotographic imaging member may be provided in a number of forms. For example, the imaging member may be a homogeneous layer of a single material such as vitreous selenium or it may be a composite layer containing a photoconductor and another material. One type of composite imaging member comprises a layer of finely divided particles of a photoconductive inorganic compound dispersed in an electrically insulating organic resin binder. U.S. Pat. No. 4,265,990 discloses a layered photoreceptor having separate photogenerating and charge transport layers. The photogenerating layer is capable of photogenerating holes and injecting the photogenerated holes into the charge transport layer.

U.S Pat. No. 4,747,992 to Sypula et al discloses a process for fabricating a belt. The belt may be used for electrostatographic imaging members as a substrate layer. The substrate layer may comprise any of a number of film forming polymers, including polycarbonates, polysulfones, polyesters, and polyvinylfluoride. Electrostatographic imaging members are also disclosed which include photogenerating layers containing photoconductive compositions and/or pigments and a resinous binder. The basis for selection from among the materials for the charge generating layer and the substrate is not disclosed.

U.S. Pat. No. 4,756,993 to Kitatani et al discloses an electrophotographic photoreceptor comprising a light-transmitting conductive support comprised of a transparent thermoplastic resin film. The resins to be used for the conductive support include polyesters, polycarbonates, polyamides, acrylic resins, polyamide-imide resins, polystyrene, polyacetals, polyolefins, etc. An electrophotographic photosensitive layer is disclosed as being an organic photoconductive layer composed of an organic photoconductive substance. Polyvinylcarbazole and its derivatives are disclosed as one such organic photoconductive substance.

U.S. Pat. No. 4,895,784 to Shirai discloses a photoconductive member comprising a drum-shaped substrate and a photoconductive layer. The substrate may be either electroconductive or dielectric. Dielectric supports include films or sheets of synthetic resins, including polyester, polyethylene, polycarbonates, cellulose acetates, polypropylene, polyvinyl chloride, polyvinylidene chloride, polystyrene, polyamide, etc. The photoconductive layer may be a vacuum deposited layer comprising an amorphous material comprising silicon atoms.

U.S. Pat. No. 4,582,772 to Teuscher et al discloses layered photoconductive imaging devices comprising a substrate of organic polymeric material such as polycarbonates, polyamides and polyurethane. A photogenerating layer is provided comprising photoconductive particles or pigments randomly dispersed in a resinous binder. Sublimation of the photogenerating layer is not disclosed.

U.S. Pat. No. 4,702,980 to Matsuura et al discloses an electrostatic recording medium. The recording medium is a sheet-like product prepared from polyolefins.

As more advanced, higher speed electrophotographic copiers, duplicators and printers were developed, degradation of image quality was encountered during extended cycling. Moreover, complex, highly sophisticated duplicating and printing systems operating at very high speeds have placed stringent requirements including narrow operating limits on photoreceptors.

Modern composite imaging members have been developed having numerous layers which are highly flexible and exhibit predictable electrical characteristics within narrow operating limits to provide excellent images over many thousands of cycles. One type of multilayered photoreceptor that has been employed as a belt in electrophotographic imaging systems comprises a substrate, a conductive layer, a blocking layer, an adhesive layer, a charge generating layer, and a charge transport layer. This photoreceptor may also comprise additional layers such as an anti-curl layer and an optional overcoating layer.

During machine function, a photoconductive imaging member is constantly under repetitive electrophotographic cycling which subjects the electrically operative layers to high electrical charging/discharging cycles, multiple exposures to light for latent imaging development and erasure, and heat due to temperature elevation as a result of machine operation. The repetitive electrical and light fatigue lead to a gradual deterioration in the electrical characteristics of the imaging member, and limit its service life in the field. In the attempt to fabricate a robust photoconductive imaging system, many innovative ideas have been attempted with the intent to overcome this shortfall and extend the electrical functional life of the imaging member.

One of the most encouraging advances in photoconductive imaging development which has emerged in recent years is the successful fabrication of a novel design of a flexible imaging member which exhibits nearly ideal capacitive charging characteristics, outstanding photosensitivity, low electrical potential dark decay, and long term electrical cyclic stability. This novel imaging member design employed in belt form comprises a substrate, a conductive layer, a solution coated hole blocking layer, a solution coated adhesive layer, a thin vacuum sublimation deposited charge generating layer of pure organic pigment, a solution extruded charge transport layer with an adjacent solution co-extruded ground strip at one edge of the imaging layers, a solution extruded anti-curl layer, and an optional overcoating layer. For example, U.S. Pat. No. 4,587,189 to Hor et al discloses photoconductive imaging members comprising a vacuum sublimation deposited benzimidazole perylene charge generating layer for photoelectric imaging and performance enhancement. This novel multilayered belt-imaging member provides excellent electrical properties and extended life, but is also seen to exhibit a major problem of charge generating layer mud-cracking. The observed charge generating layer mud-cracking consists of a two-dimensional network of cracks. Mud-cracking is believed by the present inventor to be the result of built-in internal stress in the charge generating layer due to the elevated temperature of the vacuum sublimation/deposition process and solvent penetration through the thin charge generating layer which dissolves the adhesive layer underneath during application of the charge transport layer solution.

Cracking in the charge generating layer has a serious impact on the versatility of a photoreceptor and reduces its practical value. Charge generating layer cracking not only can print out as defects, but may also act as stress concentration centers which then propagate the cracks into the other electrically operative layer, i.e., the charge transport layer, during dynamic belt machine cycling. In addition to the described mud-cracking problem, this novel imaging design also exhibits an inherent mechanical shortfall of low adhesion strength at the charge generating layer/adhesive layer interface. It has been observed that inadequate interfacial bond strength leads to frequent imaging layer delamination during dynamic fatigue belt flexing over small diameter supporting belt module rollers; that is, 19 mm diameter rollers.

While the above-mentioned imaging member gives the desirable electrical characteristic, there is an urgent need to reduce cracking in order to make the imaging member design acceptable for product implementation. It is also important to emphasize that any solution employed to solve the charge generating layer mud-cracking problem should produce no deleterious effects on the electrical and mechanical integrities of the original device.

SUMMARY OF THE INVENTION

The present inventor has discovered a source of the problem associated with the observed mud-cracking in electrophotostatic imaging devices. Internal tensile stress is built-up in the charge generating layer as a result of processes which raise the temperature of the imaging device during application of the change generating layer, for example, by sublimation-deposition of this layer onto an adhesive layer in a multilayered imaging device. For example, during the vacuum sublimation-deposition process, the organic pigment sublimes at a high temperature from a crucible and condenses onto an adhesive/blocking layer/ground plane/polyester supporting substrate to form a thin charge generating layer of about 0.65 percent of the supporting substrate thickness. During this process, the charge generating layer remains at an elevated temperature and at a stress-free state. In contrast, the temperature rise in the substrate is only slight since it has a much larger mass than the charge generating layer and since it is a good heat insulator. As the layers cool to ambient room temperature, the two-dimensional thermal contraction of the charge generating layer exceeds that of the substrate, thereby causing the development of the internal stress in the charge generating layer.

In a typical photoreceptor, a substrate is provided which in most instances comprises a polymer such as biaxially-oriented polyethylene terephthalate (PET). Upon completion of the sublimation and deposition processes, the PET substrate and the deposited charge generating layer will exhibit a difference in an amount of dimensional shrinkage (thermal contraction) between them as they cool down to ambient room temperature, due to a differential thermal contraction in which the charge generating layer contraction substantially exceeds that of the PET substrate. This mismatch in contraction has been discovered by the inventor to be a source of the internal tension stress build-up in the charge generating layer which eventually leads to the development of the observed mud-cracking problem.

Since vacuum sublimation of photosensitive organic pigment from a heated crucible is a simple process of depositing a desirably pure and thin organic pigment, in particular, benzimidazole perylene pigment, which exhibits superior electrophotographic properties needed for a long life photoreceptor design, it is therefore important to understand the mechanistic steps responsible for the development of the mud-cracking problem so that strategic solutions can be formulated to resolve the issue. In particular, during vacuum sublimation of the charge generating layer, latent heat of sublimation is absorbed by the organic pigment at a high crucible temperature as it is converted from a solid state to a vapor state. Upon striking the surface of a substrate, the vapor condenses to a solid and is deposited onto the substrate to form a stress-free coating at the elevated temperature due to evolution of the latent heat of sublimation from the pigment. In this instance, the temperature of the substrate will rise only slightly, and is a temperature which is lower than the deposited charge generating layer temperature because the substrate is a poor thermal conductor and has a mass which may be about 150 times larger than the charge generating layer. Upon cooling to room temperature, spontaneous tension stress is developed through a larger degree of contraction of the charge generating layer than that of the substrate due to a greater temperature gradient of cooling in the charge generating layer. This internal stress becomes the root for promoting the mud-cracking problem.

Adhesives commonly used in the adhesive layer are highly soluble in methylene chloride, which is a common solvent used in applying the charge transport layer coating solution. Although the sublimation-deposited charge generating layer is insoluble in the solvent used to apply the charge transport layer, it is permeable to solvent used to apply the charge transport layer because it is desirably very thin. This permeability allows for solvent penetration through the thin charge generating layer during charge transport layer coating. It has been found that penetration of solvent through the charge generating layer can adversely affect the charge generating layer/adhesive layer interface bonding due to dissolution of the adhesive layer. Without the adhesive layer anchored support, the sublimation-deposited charge generating layer releases its planar internal stress, resulting in two-dimensional mud-cracking.

It is an object of the invention to provide a materials combination for the layers in a multilayered imaging device which overcomes the problems of the prior art.

It is an object of the invention to eliminate the charge generating layer mud-cracking problem by providing material for the substrate which can produce a similar thermal contraction to match that of the sublimation-deposited charge transport layer.

It is an object of the invention to provide a substrate which has a thermal contraction coefficient much greater than about $1.7\times10^{-5}/°$ C. (the thermal contraction coefficient of a biaxially oriented PET substrate).

It is yet another object of the invention to provide an electrophotographic imaging member with improved charge generating layer resistance to mud-cracking.

It is an object of the invention to provide a substrate comprising a material having a thermal contraction coefficient between about $5\times10^{-5}/°$ C. to about $9\times10^{-5}/°$ C., which provides a dimensional contraction of the substrate substantially matching that of a charge generating layer upon cooling to ambient room temperature after sublimation and deposition processes.

These and other objects of the invention are provided in an electrophotographic imaging member comprising a supporting substrate and a vacuum sublimation deposited charge generating layer which is formed at elevated temperatures. The supporting substrate and charge generating layer have dimensional and thermal contractions (shrinkage) which do not differ by more than about 0.01 percent. In one particular embodiment, substrate materials are provided having a thermal contraction coefficient of about $5\times10^{-5}/°$ C. to about $9\times10^{-5}/°$ C. Materials having the desired thermal contraction coefficient for the supporting substrate in this particular embodiment include, for example, polyethersulfone, polyvinylfluoride, polycarbonate, and amorphous polyethylene terephthalate.

BRIEF DESCRIPTION OF THE DRAWINGS

A more complete understanding of the present invention can be obtained by reference to the accompanying Figure, which is a cross-sectional view of a multilayered photoreceptor of the invention.

DESCRIPTION OF PREFERRED EMBODIMENTS

In one embodiment of the electrophotographic imaging member according to the present invention, materials for the supporting substrate are chosen so that the substrate has a thermal contraction coefficient which is substantially the same as that of the charge generating layer. In particular, an electrophotographic imaging member of the invention may be provided with a supporting substrate, a conductive layer, a hole blocking layer, a charge generating layer and a charge transport layer. The thermal contraction coefficient of the substrate layer preferably is not less than $5.0\times10^{-5}/°$ C., more preferably not less than $6.0\times10^{-5}/°$ C., representing a thermal contraction coefficient which is at least 3.5 times greater the thermal contraction coefficient of the biaxially oriented PET. In one embodiment, the substrate materials have a thermal contraction coefficient of about $5.0\times10^{-5}/°$ C. to about $9.0\times10^{-5}/°$ C. and the charge generating layer material is benzimidazole perylene. For a better understanding of the preferred embodiments of the invention, reference will be made to a particular electrophotographic imaging member.

A representative structure of an electrophotographic imaging member is shown in FIG. 1. This imaging member is provided with an anti-curl layer 1, a supporting substrate 2, an electrically conductive ground plane 3, a hole blocking layer 4, an adhesive layer 5, a charge generating layer 6, and a charge transport layer 7. An optional overcoating layer 8 is also shown in FIG. 1.

In the above-described device, a ground strip 9 is preferably provided adjacent the charge transport layer at an outer edge of the imaging member. See U.S. Pat. No. 4,664,995. The ground strip 9 is coated adjacent to the charge transport layer so as to provide grounding contact with a grounding device (not shown) during electrophotographic processes.

A description of the layers of the electrophotographic imaging member of the present invention shown in FIG. 1 follows.

The Supporting Substrate

The supporting substrate 2 may be opaque or substantially transparent and may comprise numerous suitable materials having the required mechanical properties. In particular, the substrate should have a thermal contraction coefficient (also known as a coefficient of thermal expansion) which can produce a dimensional shrinkage in the substrate similar to that of the subsequently applied charge generating layer, in particular, a vacuum sublimation deposited charge generating layer. "Similar" or "substantially the same" dimensional contraction is meant to refer to a dimensional contraction which must not differ by more than about 0.01 percent. In a preferred embodiment, the substrate comprises a material having a thermal contraction coefficient of about $6.0\times10^{-5}/°$ C. to about $8.0\times10^{-5}/°$ C. Materials having such a thermal contraction coefficient include, for example, polyethersulfone (thermal contraction coefficient of $6.0\times10^{31\ 5}/°$ C., polyvinyl fluoride (thermal contraction coefficient of $8.0\times10^{-5}/°$ C., polycarbonates such as Makrofol available from Mobay (thermal contraction coefficient of $6.5\times10^{-5}/°$ C.), amorphous polyethylene terephthalate from ICI Americas, Inc. (thermal contraction coefficient of $6.5\times10^{-5}/°$ C.), and the like. In contrast, substrates formed from biaxially oriented polyethylene terephthalate have a thermal contraction coefficient of about $1.7\times10^{-5}/°$ C., and are thus not preferred with the particular charge generating layer material such as benzimidazole perylene. Any suitable substrate material may be used if it has a thermal contraction coefficient which is at least 3.2 times greater than that of the biaxially oriented PET.

The substrate should be flexible, and may have any number of different configurations such as, for example, a sheet, a scroll, an endless flexible belt, and the like. Preferably, the substrate is in the form of an endless flexible belt.

The preferred thickness of the substrate layer depends on numerous factors, including economic considerations. The thickness of this layer may range from about 65 micrometers to about !50 micrometers, and preferably from about 75 micrometers to about 125 micrometers for optimum flexibility and minimum induced surface bending stress when cycled around small diameter rollers, e.g., 19 millimeter diameter rollers. The substrate for a flexible belt may be of substantial thickness, for example, over 200 micrometers, or of minimum thickness, for example, less than 50 micrometers, provided there are no adverse effects on the final photoconductive device. The surface of the substrate layer is preferably cleaned prior to coating to promote greater adhesion of the deposited coating. Cleaning may be effected by exposing the surface of the substrate layer to plasma discharge, ion bombardment and the like.

The Electrically Conductive Ground Plane

The electrically conductive ground plane 3 may be an electrically conductive metal layer which may be formed, for example, on the substrate 2 by any suitable coating technique, such as a vacuum depositing technique. Typical metals include aluminum, zirconium, niobium, tantalum, vanadium, hafnium, titanium, nickel, stainless steel, chromium, tungsten, molybdenum, and the like, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer is preferably between about 20 Angstroms to about 750 Angstroms, and more preferably from about 50 Angstroms to about 200 Angstroms for an optimum combination of electrical conductivity, flexibility and light transmission.

Regardless of the technique employed to form the metal layer, a thin layer of metal oxide generally forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 9000 Angstroms or a conductive carbon black dispersed in a plastic binder as an opaque conductive layer.

The Hole Blocking Layer

After deposition of the electrically conductive ground plane layer, the hole blocking layer 4 may be applied thereto. Electron blocking layers for positively charged photoreceptors allow holes from the imaging surface of the photoreceptor to migrate toward the conductive layer. For negatively-charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen-containing siloxanes or nitrogen-containing titanium compounds such as trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)-titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, $[H_2N(CH_2)_3]CH_3Si(QCH_3)_2$, and (gamma-aminopropyl) methyl diethoxysilane, as disclosed in U.S. Pat. Nos. 4,338,387, 4,286,033 and 4,291,110. A preferred hole blocking layer comprises a reaction product of a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low RH. The hydrolyzed silanes have the general formula

I

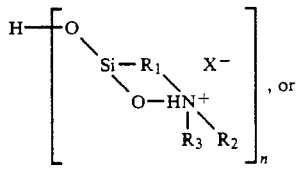

, or

II

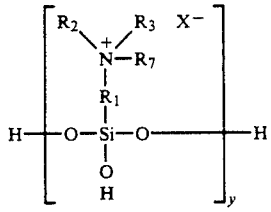

wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is an anion of an acid or acidic salt, n is 1–4, and y is 1–4. The imaging member is preferably prepared by depositing on the metal oxide layer of a metal conductive layer, a coating of an aqueous solution of the hydrolyzed aminosilane at a pH between about 4 and about !0, drying the reaction product layer to form a siloxane film and applying an adhesive layer, and thereafter applying electrically operative layers, such as a photogenerator layer and a hole transport layer, to the adhesive layer.

The hole blocking layer should be continuous and have a thickness of less than about 0.5 micrometer because greater thicknesses may lead to undesirably high residual voltage. A hole blocking layer of between about 0.005 micrometer and about 0.3 micrometer is preferred because charge neutralization after the exposure step is facilitated and optimum electrical performance is achieved. A thickness between about 0.03 micrometer and about 0.06 micrometer is preferred for hole blocking layers for optimum electrical behavior. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is preferably applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

The Adhesive Layer

In most cases, intermediate layers between the blocking layer and the adjacent charge generating or photogenerating layer may be desired to promote adhesion. For example, the adhesive layer 5 may be employed. If such layers are utilized, they preferably have a dry thickness between about 0.01 micrometer to about 0.2 micrometer. Typical adhesive layers include film-forming polymers such as polyester, du Pont 49,000 resin (available from E.I. du Pont de Nemours & Co.), Vitel PE-100 (available from Goodyear Rubber & Tire Co.), polyvinylbutyral, polyvinylpyrrolidone, polyurethane, polymethyl methacrylate, and the like.

The Charge Generating Layer

Any suitable charge generating (photogenerating) layer 6 which has the above relationship of thermal contraction coefficient with the selected substrate may be applied to the adhesive layer 5. The charge generating layer of the invention may, for example, comprise any photogenerating material which is formed at elevated temperatures. For example, the photogenerating material can be vacuum sublimation deposited. Examples of materials out of which photogenerating layers can be vacuum sublimation deposited include photoconductive perylene and phthalocyanine pigments, for example, benzimidazole perylene and chloro indium phthalocyanine. Perylene pigments which may be used in the present invention include those disclosed in U.S. Patent No. 4,587,189 to Hor et al, incorporated herein. A particularly preferred perylene pigment is benzimidazole perylene. Other phthalocyanine pigments include the X-form of metal free phthalocyanine described in U.S. Patent No. 3,357,989, and metal phthalocyanines in the forms of vanadyl phthalocyanine, titanyl phthalocyanine and copper phthalocyanine. Other pigments of interest include, for example, dibromoanthanthrone; squarylium; quinacridones available from du Pont under the tradename Monastral Red, Monastral Violet and Monastral Red Y; Vat orange 1 and Vat orange 3 trade names for dibromo anthanthrone pigments; substituted 2,4-diamino-triazines disclosed in U.S. Pat. No. 3,442,781; polynuclear aromatic quinones available from Allied Chemical Corporation under the tradename Indofast Double Scarlet, Indofast Violet Lake B, Indofast Brilliant Scarlet and Indofast Orange; and the like. Multi-photogenerating layer compositions may be utilized where a photoconductive layer enhances or reduces the properties of the photogenerating layer. Other suitable photogenerating materials known in the art and which can be vacuum sublimated may also be utilized, if desired. Charge generating layers comprising a photoconductive material such as vanadyl phthalocyanine, metal free phthalocyanine, benzimidazole perylene, and the like and mixtures thereof are especially preferred because of their sensitivity to white light. However, chloro indium phthalocyanine, vanadyl phthalocyanine, and metal free phthalocyanine are also preferred because these materials provide the additional benefit of being sensitive to infrared light.

The charge generating layer may be applied by any process which requires elevated temperatures, for example, by vacuum coating. Elevated temperature is meant to refer to a temperature which is about 50° -150° C. above room temperature, and typically is about 500°-650° C. above room temperature. Use of a sublimation-deposition process is desirable to obtain a thin charge generating layer without the need of a polymer binder. Thin charge generating layers are desirable because they permit intimate pigment-to-pigment contact and provide a shorter charge carrier traveling path to reach the charge transport layer for efficient electrophotographic imaging process enhancement. The preferred sublimation deposited organic charge generating layer thickness ranges between about 0.3 micrometer and about 1.2 micrometers. Charge generating layers which contain 50 percent by volume pigment dispersed in a binder as described, for example, in U.S. Pat. No. 3,121,006, need to be twice as thick as a sublimation deposited one. However, permeability to solvents is more apparent with the thin charge generating layers. Though not dissolving the charge generating layer, the solvents may destroy the interfacial bonding between the adhesive layer and the charge generating layer. Upon cooling, this leads to the release of the charge generating layer's planar internal stress, thereby resulting in mud-cracking.

The Charge Transport Layer

The charge transport layer 7 may comprise any suitable transparent organic polymer or non-polymeric material capable of supporting the injection of photogenerated holes and electrons from the charge generating layer 6 and allowing the transport of these holes or electrons through the organic layer to selectively discharge the surface charge. The charge transport layer not only serves to transport holes or electrons, but also protects the photoconductive layer from abrasion or chemical attack and therefore extends the operating life of the photoreceptor imaging member. The charge transport layer should exhibit negligible, if any, discharge when exposed to a wavelength of light useful in xerography, e.g. 4000 Angstroms to 9000 Angstroms. The charge transport layer is substantially transparent to radiation in a region in which the photoconductor is to be used. It is comprised of a substantially non-photoconductive material which supports the injection of photogenerated holes from the charge generating layer. The charge transport layer is normally transparent when exposure is effected therethrough to ensure that most of the incident radiation is utilized by the underlying charge generating layer. When used with a transparent substrate, imagewise exposure or erase may be accomplished through the substrate with all light passing through the substrate. In this case, the charge transport material need not transmit light in the wavelength region of use. The charge transport layer in conjunction with the charge generating layer is an insulator to the extent that an electrostatic charge placed on the charge transport layer is not conducted in the absence of illumination.

The charge transport layer may comprise activating compounds dispersed in normally electrically inactive polymeric materials for making these materials electrically active. These compounds may be added to polymeric materials which are incapable of supporting the injection of photogenerated holes and incapable of allowing the transport of these holes. An especially preferred transport layer employed in multilayer photoconductors comprises from about 25 percent to about 75 percent by weight of at least one charge transporting aromatic amine compound, and about 75 percent to about 25 percent by weight of a polymeric film-forming resin in which the aromatic amine is soluble.

The charge transport layer is preferably formed from a mixture comprising an aromatic amine compound of one or more compounds having the general formula:

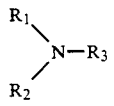

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl groups having from 1 to 18 carbon atoms and cycloaliphatic compounds having from 3 to 18 carbon atoms. The substituents should be free from electron-withdrawing groups such as $NO_2$ groups, CN groups, and the like. Typical aromatic amine compounds that are represented by this structural formula include:

I. Triphenyl amines such as:

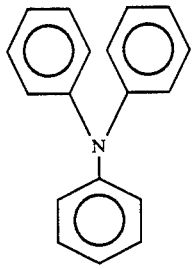

II. Bis and poly triarylamines such as:

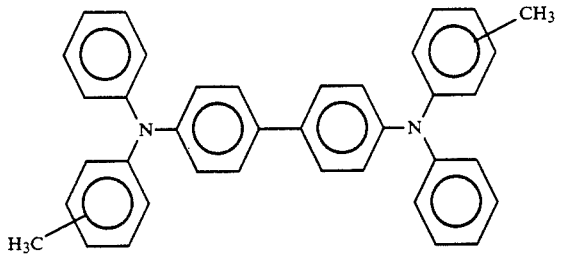

III. Bis arylamine ethers such as:

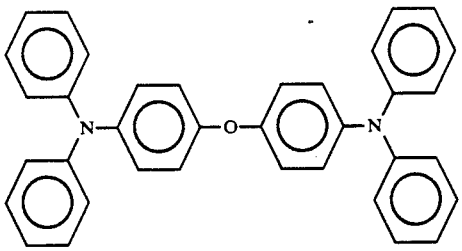

and

IV. Bis alkyl-arylamines such as:

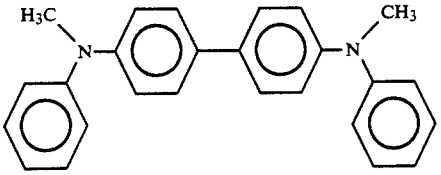

A preferred aromatic amine compound has the general formula:

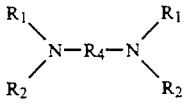

wherein $R_1$, and $R_2$ are defined above and $R_4$ is selected from the group consisting of a substituted or unsubstituted biphenyl group, diphenyl ether group, alkyl group having from 1 to 18 carbon atoms, and cycloaliphatic group having from 3 to 12 carbon atoms. The substituents should be free from electron-withdrawing groups such as $NO_2$ groups, CN groups, and the like.

Examples of charge-transporting aromatic amines represented by the structural formulae above include triphenylmethane, bis(4-diethylamine-2-methylphenyl)-phenylmethane; 4,4'-bis(diethylamino)-2,2'-dimethyltriphenylmethane, N,N'-bis(alkyl-phenyl)-1,1'-biphenyl)-4,4'-diamine wherein the alkyl is, for example, methyl, ethyl, propyl, n-butyl, etc., N,N'-diphenyl-N,N'-bis(3-methyl-phenyl)-(1,1'-biphenyl)-4,4'-diamine, and the like, dispersed in an inactive resin binder.

Any suitable inactive resin binder soluble in methylene chloride or other suitable solvents may be employed, provided that the material used in the adhesive layer is insensitive to the solvent used. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000. Other solvents that may dissolve these binders include tetrahydrofuran, toluene, trichloroethylene, 1,1,2-trichloroethane, 1,1,1-trichloroethane, and the like.

The preferred electrically inactive resin materials are polycarbonate resins having a molecular weight from about 20,000 to about 120,000, more preferably from about 50,000 to about 100,000. The materials most preferred as the electrically inactive resin material are poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from General Electric Company; Makrolon, a polycarbonate resin having a molecular weight of from about 50,000 to about 100,000, available as Makrolon from Farbenfabricken Bayer A.G.; Merlon, a polycarbonate resin having a molecular weight of from about 20,000 to about 50,000, available as Merlon from Mobay Chemical Company; polyether carbonates; and 4,4'-cyclohexylidene diphenyl polycarbonate. Methylene chloride solvent is a desirable component of the charge transport layer coating mixture for adequate dissolving of all the components and for its low boiling point.

The thickness of the charge transport layer may range from about !0 micrometers to about 50 micrometers, and preferably from about 20 micrometers to about 35 micrometers. Optimum thicknesses may range from about 23 micrometers to about 31 micrometers.

The Ground Strip

The ground strip may comprise a film-forming polymer binder and electrically conductive particles. Cellulose may be used to disperse the conductive particles. Any suitable electrically conductive particles may be used in the electrically conductive ground strip layer 9 of this invention. The ground strip 9 may comprise materials which include those enumerated in U.S. Pat. No. 4,664,995. Typical electrically conductive particles include carbon black, graphite, copper, silver, gold, nickel, tantalum, chromium, zirconium, vanadium, niobium, indium tin oxide and the like. The electrically conductive particles may have any suitable shape. Typical shapes include irregular, granular, spherical, elliptical, cubic, flake, filament, and the like. Preferably, the electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer may have a thickness from about 7 micrometers to about 42 micrometers, and preferably from about 14 micrometers to about 27 micrometers.

The Anti-Curl Layer

The anti-curl layer 1 is optional, and may comprise organic polymers or inorganic polymers that are electrically insulating or slightly semi-conductive. The anti-curl layer provides flatness and/or abrasion resistance.

Anti-curl layer 1 may be formed at the back side of the substrate -2, opposite to the imaging layers. The anti-curl layer may comprise a film-forming resin and an adhesion promoter polyester additive. Examples of filmforming resins include polyacrylate, polystyrene, poly(4,4'-isopropylidene diphenyl carbonate), 4,4'-cyclohexylidene diphenyl polycarbonate, and the like. Typical adhesion promoters used as additives include 49,000 (du Pont), Vitel PE-100, Vitel PE-200, Vitel PE-307 (Goodyear), and the like. Usually from about 1 to about 15 weight percent adhesion promoter is selected for filmforming resin addition. The thickness of the anti-curl layer is from about 3 micrometers to about 35 micrometers, and preferably about 14 micrometers.

The Overcoating Layer

The optional overcoating layer 8 may comprise organic polymers or inorganic polymers that are electrically insulating or slightly semi-conductive. The overcoating layer may range in thickness from about 2 micrometers to about 8 micrometers, and preferably from about 3 micrometers to about 6 micrometers. An optimum range of thickness is from about 3 micrometers to about 5 micrometers.

The invention will further be illustrated in the following, non-limiting examples, it being understood that these examples are intended to be illustrative only and that the invention is not intended to be limited to the materials, conditions, process parameters and the like recited therein.

COMPARATIVE EXAMPLE I

A photoconductive imaging member is prepared by providing a web of titanium coated biaxially oriented PET (Melinex, available from ICI Americas Inc.) substrate having a thickness of 3 mils, and applying thereto, with a gravure applicator using a production coater, a solution containing 50 grams 3-amino-propyltriethoxysilane, 15 grams acetic acid, 684.8 grams of 200 proof denatured alcohol and 200 grams heptane. This layer is then dried for about 5 minutes at 135° C. in the forced air drier of the coater. The resulting blocking layer has a dry thickness of 0.05 micrometer.

An adhesive interface layer is then prepared by applying a wet coating over the blocking layer, using a gravure applicator, containing 0.5 percent by weight based on the total weight of the solution of copolyester adhesive (du Pont 49,000, available from E.I. du Pont de Nemours & Co.) in a 70:30 volume ratio mixture of tetrahydrofuran/cyclohexanone. The adhesive interface layer is then dried for about 5 minutes at 135° C. in the forced air drier of the coater. The resulting adhesive interface layer has a dry thickness of 0.062 micrometer.

A piece of 9 inches × 12 inches sample is then cut from the web, and a 0.5 micrometer thickness benzimidazole perylene charge generating pigment is vacuum sublimation deposited over the du Pont 49,000 adhesive layer from a heated crucible. The sublimation-deposition process is carried-out in a vacuum chamber under about $4\times10^{-5}$ mm Hg pressure and a crucible temperature of about 550° C.

This benzimidazole perylene coated member is removed from the vacuum chamber and overcoated with a charge transport layer. The charge transport layer coating solution is prepared by introducing into an amber glass bottle in a weight ratio of 1:1 N,N'-diphenyl-N,N'-bis(3-methyl-phenyl)-1,1'-biphenyl-4,4'-diamine and Makrolon 5705, a polycarbonate resin having a molecular weight of about 100,000 and commercially available from Farbenfabricken Bayer A.G. The resulting mixture is dissolved by adding methylene chloride to the glass bottle to form a 16 percent weight solid charge transport layer solution. This solution is applied on the photogenerator layer by hand coating using a 3 mil gap Bird applicator to form a wet coating which upon drying at 135° in a forced air oven for 6 minutes gives a dry charge transport layer thickness of 24 micrometers. During the transport layer coating process the humidity is controlled at or less than 15 percent.

After the charge transport layer coating, the imaging member exhibits spontaneous upward curling. An anti-curl coating is needed to render the imaging member the desired flatness. The anti-curl coating solution is prepared in a glass bottle by dissolving 8.82 grams polycarbonate (Makrolon 5705, available from Bayer AG) and 0.09 grams copolyester adhesion promoter (Vitel PE-100, available from Goodyear Tire and Rubber Company) in 90.07 grams methylene chloride. The glass bottle is then covered tightly and placed on a roll mill for about 24 hours until total dissolution of the polycarbonate and the copolyester is achieved. The anti-curl coating solution thus obtained is applied to the rear surface of the supporting substrate (the side opposite to the imaging layers) of the photoreceptor device by hand coating using a 3 mil gap Bird applicator. The coated wet film is dried at 135° C. in an air circulation oven for about 5 minutes to produce a dry, !4 micrometers thick anti-curl layer.

EXAMPLE II

A photoconductive imaging member having two electrically operative layers (the charge generating and the charge transport layers) as described in COMPARATIVE EXAMPLE I is prepared using the same procedures, conditions, and materials except that the biaxially oriented PET substrate which has a thermal contraction coefficient of $1.7\times10^{-5}/°$ C. is replaced by a 4 mil polyethersulfone substrate (Stabar S100, available from ICI Americas, Inc.). The thermal contraction coefficient of the polyethersulfone substrate is $6.0\times10^{-5}/°$ C. The 49,000 adhesive layer in this imaging member has a thickness of about 0.065 micrometer. Since this imaging member does not curl, an anti-curl layer is therefore not needed.

EXAMPLE III

The same procedures and materials as described in COMPARATIVE EXAMPLE I are used to prepare a photoconductive imaging member, except that the biaxially oriented PET is replaced by a 4 mil polyvinyl fluoride substrate (Tedlar PVF, available from E.I. du Pont de Nemours & Co.). The thermal contraction coefficient of the PVF substrate is $8.0\times10^{-5}/°$ C. The 49,000 adhesive thickness in this imaging member is about 0.059 micrometer. Since this imaging member is curl-free, no anti-curl layer is coated.

EXAMPLE IV

The same procedures and materials as described in COMPARATIVE EXAMPLE I are used to prepare a photoconductive imaging member, except that the biaxially oriented PET is replaced by a 4 mil polycarbonate substrate (Makrofol, available from Mobay Chemicals). The thermal contraction coefficient of the Makrofol substrate is $6.5\times10^{-5}/°$ C. The 49,000 adhesive thickness in this imaging member is about 0.069 micrometer. Since the resulting imaging member is curl-free, an anti-curl layer is not needed.

EXAMPLE V

The same procedures and materials as described in COMPARATIVE EXAMPLE I are used to prepare a photoconductive imaging member, except that the biaxially oriented PET is replaced by a 4 mil amorphous PET substrate (available from ICI Americas Inc.). The thermal contraction coefficient of the amorphous PET substrate is $6.5\times10^{-5}/°$ C. The 49,000 adhesive thickness in this imaging member is about 0.064 micrometer. Since the resulting imaging member is curl-free, application of an anti-curl layer is not required.

EXAMPLE VI

The photoconductive imaging members having the substrates of the present invention are evaluated for 180° peel strength and examined for benzimidazole perylene charge generating layer mud-cracking.

The 180° peel strength is determined by cutting a minimum of five 0.5 inch × 6 inches imaging member samples from each of Examples I through V. For each sample, the charge transport layer is partially stripped from the test imaging member sample with the aid of a razor blade and then hand peeled to about 3.5 inches from one end to exposed part of the underlying charge generating layer. The test imaging member sample is secured with its charge transport layer surface toward a 1 inch × 6 inches × 0.5 inch aluminum backing plate with the aid of two sided adhesive tape. At this condition, the anti-curl layer/substrate of the stripped segment of the test sample can easily be peeled 180° away from the sample to cause the adhesive layer to separate from the charge generating layer. The end of the resulting assembly opposite to the end from which the charge transport layer is not stripped is inserted into the upper jaw of an Instron Tensile Tester. The free end of the partially peeled anticurl/substrate strip is inserted into the lower jaw of the Instron Tensile Tester. The jaws are activated at a 1 inch/min crosshead speed, a 2 inch chart speed and a load range of 200 grams to peel the sample 180° to at least 2 inches. The load monitored with a chart recorder is calculated to give the peel strength by dividing the average load required for stripping the anti-curl layer by the width of the test sample.

The effectiveness of using an alternate substrate having a greater thermal contraction coefficient for biaxially oriented PET substitution to resolve the charge generating layer mud-cracking problem is analyzed by examining each photoconductive imaging member with an optical transmission microscope at 100 times magnification. The results obtained for 180° peel strength measurement and mud-cracking examination are listed in Table I below:

TABLE I

| EXAMPLE | Peel Strength (gm/cm) | Mud-cracking |
|---|---|---|
| I (Control) | 6.2 | Yes |
| II | 13.2 | No |
| III | 12.6 | No |
| IV | 13.5 | No |
| V | 11.8 | No |

The above data shows that using the substrate of the present invention for biaxially oriented PET substrate replacement not only can resolve the benzimidazole perylene charge generating layer mud-cracking problem through the elimination of internal stress from the charge generating layer, these alternate substrates seem to produce substantial adhesion enhancement as well. The observed adhesion improvement in the photoconductive imaging members of the present invention should provide greater resistance to layer delamination in a machine service environment. Let it be noted that the invention substrates have a thermal contraction coefficient from about 3.6 times to about 4.7 times greater than the biaxially oriented PET substrate control. Since the invention concept calls only for the substitution of the biaxially oriented PET substrate by an alternate substrate without changing, modifying, or disturbing the electrically operative layers, the electrophotographic integrity of the original imaging member is therefore maintained.

While the invention has been described with reference to particular preferred embodiments, the invention is not limited to the specific examples given, and other embodiments and modifications can be made by those skilled in the art without departing from the spirit and scope of the invention.

What is claimed is:

1. An electrophotographic imaging member, comprising:

a charge generating layer and a supporting substrate, the supporting substrate being comprised of a material having a thermal contraction which is substantially the same as a thermal contraction of said charge generating layer.

2. The imaging member of claim 1, wherein said thermal contractions do not differ by more than about 0.01 percent.

3. The imaging member of claim 1, wherein said charge generating layer is vacuum sublimation deposited.

4. The imaging member of claim 1, wherein said substrate has a thermal contraction coefficient between about $5.0\times10^{-5}/°$ C. and about $9.0\times10^{-5}/°$ C.

5. The imaging member of claim 1, wherein said charge generating layer comprises at least one of a perylene pigment and a phthalocyanine pigment.

6. The imaging member of claim 1, wherein said charge generating layer comprises at least one of benzimidazole perylene and chloro indium phthalocyanine.

7. The imaging member of claim 5, wherein said substrate comprises at least one member selected from the group consisting of polyethersulfone, polyvinyl fluoride, polycarbonate, and amorphous polyethylene terephthalate.

8. The imaging member of claim 1, wherein said substrate has a thickness of about 65 micrometers to about 150 micrometers.

9. The imaging member of claim 1, further comprising a charge transport layer.

10. An electrophotographic imaging member, comprising:

a supporting substrate;

a conductive layer;

a charge blocking layer;

an adhesive layer;

a charge generating layer; and a charge transport layer;

wherein said supporting substrate comprises a material having a thermal contraction which does not differ from a thermal contraction of said charge generating layer by more than about 0.01 percent.

11. The imaging member of claim 10, wherein said substrate has a thermal contraction coefficient between about $6.0\times10^{-5}/°$ C. and about $8.0\times10^{-5}/°$ C.

12. The imaging member of claim 10, wherein said charge generating layer is vacuum sublimation deposited.

13. The imaging member of claim 10, said charge generating layer comprises at least one of a perylene pigment and a phthalocyanine pigment.

14. The imaging member of claim 10, wherein said charge generating layer comprises at least one of benzimidazole perylene and chloro indium phthalocyanine.

15. The imaging member of claim 13, wherein said substrate comprises at least one member selected from the group consisting of polyethersulfone, polyvinyl fluoride, polycarbonate, and amorphous polyethylene terephthalate.

16. A method of making an electrophotographic imaging member, comprising:

forming a substrate layer;

forming a charge generating layer at an elevated temperature above said substrate layer;

wherein said layers are formed such that a difference in thermal contraction between the substrate layer and charge generating layer is no more than about 0.01 percent.

17. The method of claim 16, wherein said charge generating layer is formed at an elevated temperature.

18. The method of claim 17, wherein an adhesive layer is formed between said substrate layer and said charge generator layer.

19. The method of claim 16, wherein said substrate layer has a thermal contraction coefficient between about $5.0\times10^{-5}/°$ C. and about $9.0\times10^{-5}/°$ C.

20. The method of claim 19, wherein said charge generating layer comprises at least one of a perylene pigment and a phthalocyanine pigment.

21. The method of claim 19, wherein said charge generating layer comprises at least one of benzimidazole perylene and chloro indium phthalocyanine.

22. The method of claim 21, wherein said substrate comprises at least one member selected from the group consisting of polyethersulfone, polyvinyl fluoride, polycarbonate and amorphous polyethyleneterephthalate.

23. The method of claim 16, wherein the charge generating layer is sublimation-deposited on an adhesive layer, and a charge transport layer is solution coated on said charge generating layer with a solvent in which said adhesive layer is soluble.

24. The method of claim 23, wherein said solvent is methylene chloride.

* * * * *